US009175480B1

(12) United States Patent
Polston

(10) Patent No.: US 9,175,480 B1
(45) Date of Patent: Nov. 3, 2015

(54) ROOF RIDGE VENT

(75) Inventor: Scott Ross Polston, New Braunfels, TX (US)

(73) Assignee: Ross Manufacturing, LLC, New Braunfels, TX (US)

( * ) Notice: Subject to any disclaimer, the term of this patent is extended or adjusted under 35 U.S.C. 154(b) by 848 days.

(21) Appl. No.: 13/467,802

(22) Filed: May 9, 2012

(51) Int. Cl.

| | |
|---|---|
| ***F24F 7/02*** | (2006.01) |
| ***F24F 13/08*** | (2006.01) |
| ***E04D 13/17*** | (2006.01) |
| *E04D 1/36* | (2006.01) |

(52) U.S. Cl.
CPC ..... *E04D 13/174* (2013.01); *F24F 7/02* (2013.01); *E04D 1/36* (2013.01)

(58) Field of Classification Search
USPC ..... 454/365, 364, 239; 292/341; 52/198
IPC ..... F24F 7/02; E04D 13/174,13/176, 1/36, E04D 3/40
See application file for complete search history.

(56) References Cited

U.S. PATENT DOCUMENTS

| | | | | |
|---|---|---|---|---|
| 4,803,813 | A | 2/1989 | Fiterman | |
| 5,112,278 | A * | 5/1992 | Roberts | 454/365 |
| 5,331,783 | A | 7/1994 | Kasner et al. | |
| 5,535,558 | A | 7/1996 | Rieke et al. | |
| 5,600,928 | A | 2/1997 | Hess et al. | |
| 5,651,734 | A | 7/1997 | Morris | |
| 6,128,869 | A | 10/2000 | Brotherton et al. | |
| 6,149,517 | A * | 11/2000 | Hansen | 454/365 |
| 6,227,963 | B1 | 5/2001 | Headrick | |
| 6,277,024 | B1 | 8/2001 | Coulton | |
| 6,981,916 | B2 | 1/2006 | Coulton | |
| 7,662,037 | B2 * | 2/2010 | Polston | 454/365 |
| D694,394 | S * | 11/2013 | Polston | D23/393 |
| 2004/0088928 | A1 | 5/2004 | Headrick | |
| 2010/0112932 | A1 * | 5/2010 | Grubka et al. | 454/365 |

* cited by examiner

*Primary Examiner* — Steven B McAllister
*Assistant Examiner* — Helena Kosanovic
(74) *Attorney, Agent, or Firm* — Eric Karich; Karich & Associates

(57) ABSTRACT

A ridge vent has an elongated body, a plurality of ventilation slots, and a separation line that permits easy separation of an outer edge portion of the elongated body. Each of a first set of holes adjacent the separation line has a downwardly extending cylindrical body. Each of a second set of holes adjacent the separation line has a mating cylindrical body adapted to engage and nest within the downwardly extending cylindrical body of one of the second set of holes. Moreover, a width of the ridge vent may be reduced by separating the outer edge portion from the elongated body, overlapping it with the elongated body, and engaging the mating cylindrical bodies with the downwardly extending cylindrical bodies.

13 Claims, 6 Drawing Sheets

ROOF RIDGE VENT

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to vents for air circulation in the attic space between roof and ceiling in building structures, and more particularly to roof ridge vent structures which may be modified on site to accommodate various sizes of standard roof cap shingles.

2. Description of Related Art

The following art defines the present state of this field:

Polston, U.S. Pat. No. 7,662,037, teaches a roof ridge vent that is formed with separation lines parallel with its outer edges which permit separation of the outer edge portions of the structure. In its original configuration, the roof vent structure may be used with wide cap shingles. Removal of the outer edge portions permits the ridge vent to be used in connection with narrower cap shingles. The Polston '037 patent fails to teach, however, the interlocking components and the ventilation slots adjacent each of the side edges of the present invention.

Coulton, U.S. Pat. No. 6,277,024, teaches an adjustable-pitch sectional roof ridge vent formed as a one-piece, plastic, injection-molded body having an elongate top wall and a pair of opposed outer sidewalls depending outwardly and downwardly from peripheral longitudinal edges of the top wall. Each of the outer sidewalls has a lowermost edge, a plurality of ventilation openings, and an upturned flange projecting from the lowermost edge. The vent has a pair of opposed, integrally-formed end walls which depend from opposite ends of the top wall and which are each formed by a plurality of separate, spaced apart wall segments extending across the end of the top wall in substantially end-to-end single file alignment. Each pair of adjacent wall segments are spaced apart to form an open gap therebetween to enable ready flexing of the vent, and selected ones of the wall segments have an undulating configuration such that they interconnect to the top wall via a sinusoidal shaped juncture.

Coulton, U.S. Pat. No. 6,981,916, teaches a ridge vent, roof ridge vent installation, and method of installing a ridge vent is provided. Preferably, the ridge vent includes a ventilation material that has opposite longitudinally-extending side edges that are covered with an air permeable filter material. A longitudinally-extending central section of the vent is not covered by the air permeable filter material, is transparent, and enables a ventilating air flow to pass through the vent in a manner requiring only a single pass through the air permeable material. This permits greater air flow through the vent, and the transparent central section simplifies and enables accurate placement of the vent on the roof ridge.

Fiterman, U.S. Pat No. 4,803,813, Kasner et al., U.S. Pat. No.5,331,783, Ricke et al., U.S. Pat. No. 5,535,558, Hess et al., U.S. Pat. No. 5,600,928, Morris, U.S. Pat. No. 5,651,734, Brotherton et al., U.S. Pat. No. 6,128,869, Headrick, U.S. Pat. No. 6,227,963, and Headrick et al., U.S. 2004/0088928 also teach a variety of roof ridge vents used as a means to ventilate the attic space between the roof and ceiling of a building. The above-described references are hereby incorporated by reference in full.

SUMMARY OF THE INVENTION

The present invention teaches certain benefits in construction and use which give rise to the objectives described below.

The present invention provides a ridge vent for providing ventilation to an attic space of a building. The ridge vent includes an elongated body with a top surface, a bottom surface, and side edges. The ridge vent further includes a plurality of ventilation slots adjacent each of the side edges, as well as a separation line. The separation line permits easy separation of an outer edge portion of the elongated body, which extends generally parallel to one of the side edges. A first set of holes is adjacent to the separation line, and each of the first set of holes have a downwardly extending cylindrical body. A second set of holes is adjacent to the separation line, and each of the second set of holes are opposite one of the first set of holes. Furthermore, each of the second set of holes has a mating cylindrical body adapted to engage and nest within the downwardly extending cylindrical body of one of the second set of holes. Moreover, a width of the ridge vent may be reduced by separating the outer edge portion from the elongated body, overlapping it with the elongated body, and engaging the mating cylindrical bodies with the downwardly extending cylindrical bodies.

A primary objective of the present invention is to provide a ridge vent having advantages not taught by the prior art.

Another objective is to provide a ridge vent which may be easily modified from a wider configuration to a narrower configuration, so that a single ridge vent is able to be adapted to multiple uses with different width requirements, thereby limiting the number of products that must be carried by retailers and construction personnel.

A further objective is to provide a ridge vent that provides ventilation to a roof without allowing water to leak into the roof.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a ridge vent 10 for providing ventilation to an attic space 12 of a building.

Figure 1:
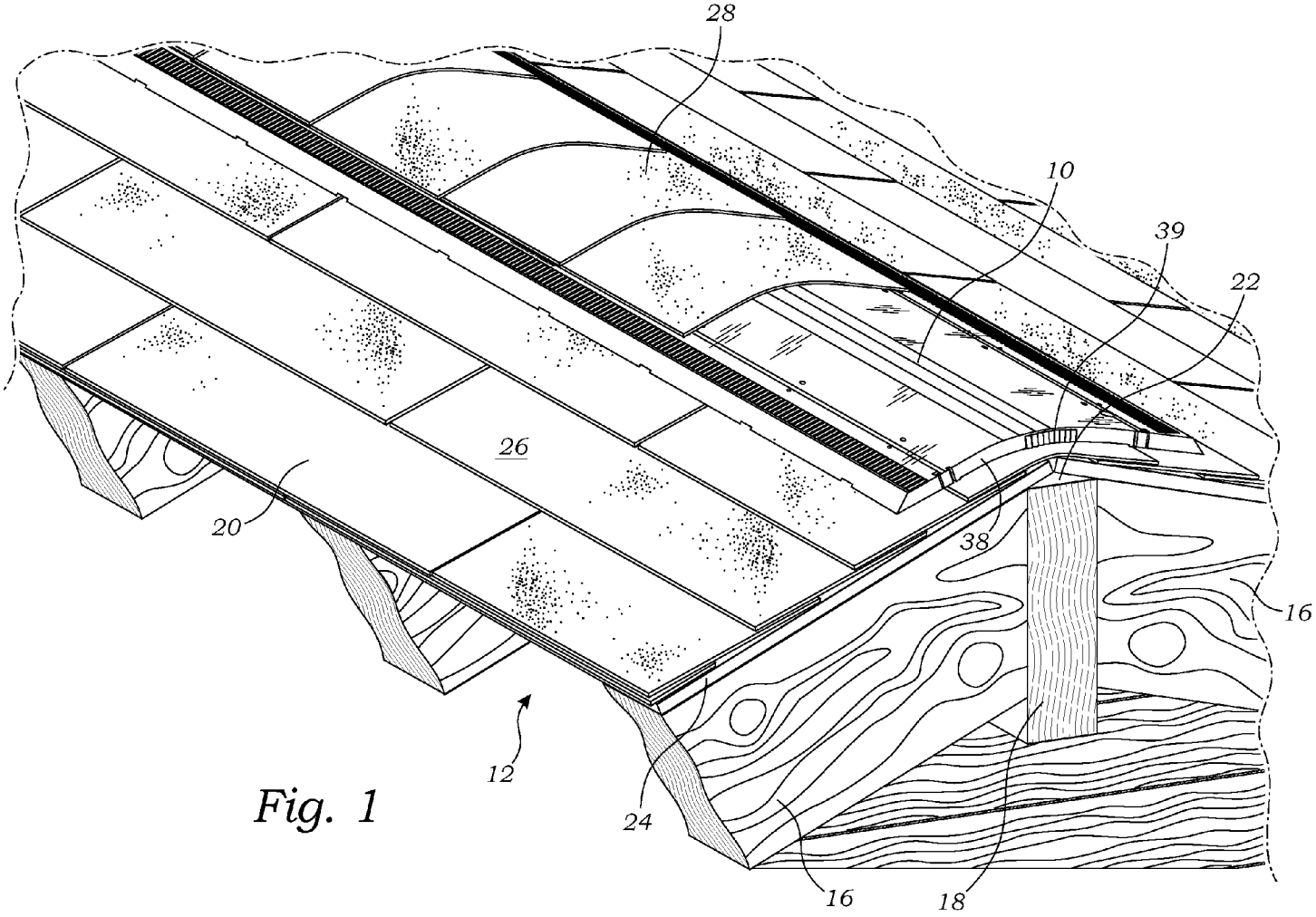
FIG. 1 is a perspective view, partially in section and partially broken away, of a pitched roof employing one embodiment of a ridge vent.

FIG. 1 is a perspective view, partially in section and partially broken away, of a pitched roof 20 employing one embodiment of the ridge vent 10. As illustrated in FIG. 1, the pitched roof 20 is formed by a plurality of inclined rafters 16 which are employed in pairs with their upper opposed ends joined with a ridge beam 18 to form an apex 22 of the pitched roof 20. A roof deck 24, typically of plywood or other suitable material, is secured to the rafters 16 to provide the structural base of the pitched roof 20. The roof deck 24 is typically covered with overlapping shingles 26. A vent (not shown) is cut into or otherwise formed at the apex 22 of the roof deck 24. Then, the vent (not shown) is bridged with the ridge vent 10, and cap shingles 28 are then secured to the ridge vent 10 to complete the pitched roof 20.

Figure 2:
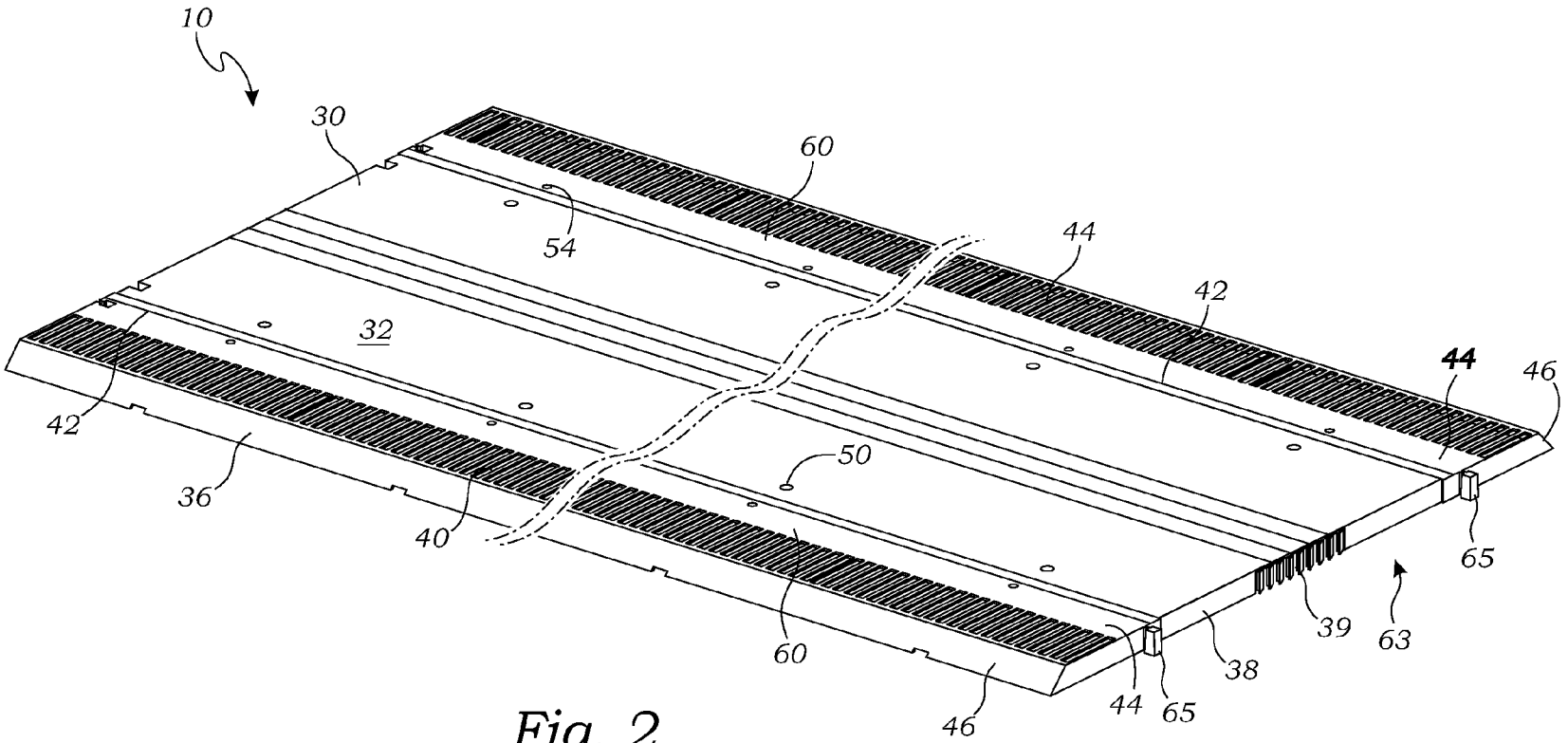
FIG. 2 is a perspective view of the ridge vent, illustrating an elongated body of the ridge vent and a pair of outer edge portions.

FIG. 2 is a perspective view of the ridge vent 10 of FIG. 1. As shown in FIGS. 1 and 2, the ridge vent 10 includes an elongated body 30, a plurality of ventilation slots 40, and a separation line 42 for forming an outer edge portion 60. The width of the elongated body 30 may be reduced to accommodate the size of the cap shingles 28 by separating the outer edge portions 60 along the separation line 42 and reattaching the outer edge portions 60 back onto the elongated body 30. Air may then flow through the plurality of ventilation slots 40 on the ridge vent 10 to ventilate the attic space 12. The details of these aforementioned elements will be discussed at length below.

The elongated body 30 has a top surface 32, a bottom surface 34, side edges 36, and an end wall 38. The top surface 32 may be substantially smooth and adapted to be covered by the cap shingles 28 on the pitched roof 20. In the embodiment of FIGS. 1 and 2, in order to allow the ridge vent 10 to flex along the apex 22 of the pitched roof 20, the end wall 38 of the elongated body 30 may be separated into offset sections 39. Thus, as the elongated body 30 is flexed along the apex 22 of the pitched roof 20, the offset sections 39 act as shutters closing the gaps in the end wall 38 without inhibiting flexing of the elongated body 30. However, while one embodiment of the elongated body 30 is illustrated in FIGS. 1 and 2, alternative embodiments devised by one skilled in the art are still considered within the scope of this discussion.

In one embodiment of the ridge vent 10, each of the outer edge portions 60 may include an outwardly extending portion 44 that is generally parallel to the elongated body 30, and a downwardly extending wall 46 that forms the side edge 36. The outwardly extending portion 44 may include the plurality of ventilation slots 40, and the downwardly extending wall 46 may be substantially unbroken in order to exclude water being blown up the roof 20, thereby removing the need for a complex and expensive baffling system such as is used in the prior art.

Figure 5:
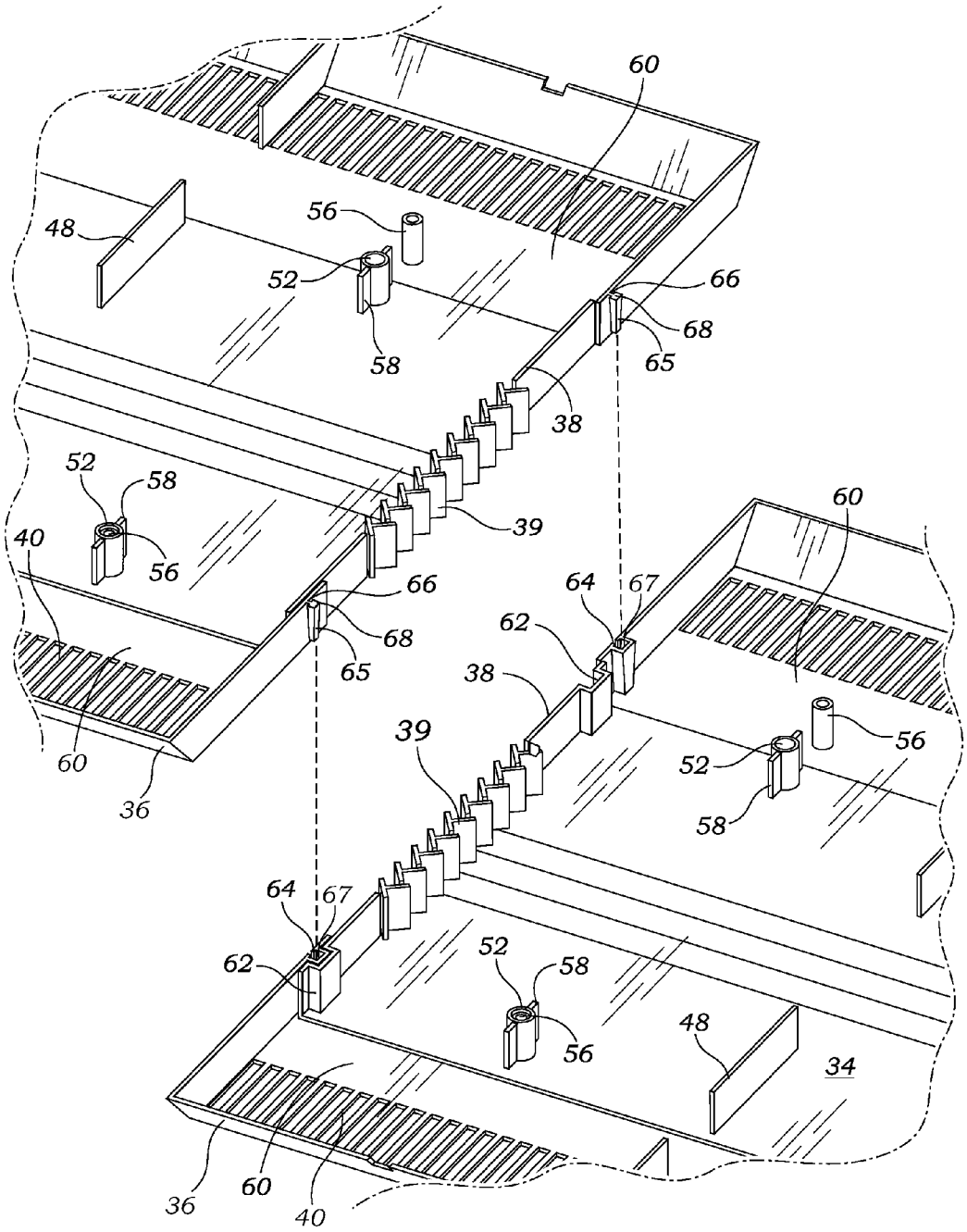
FIG. 5 is a bottom perspective exploded view of two ridge vents, illustrating a connector being used for connecting the two ridge vents into one continuous length.

The ventilation slots 40 on the outwardly extending portion 44 allow for the inward/outward passage of air (as illustrated in FIG. 5) through the ridge vent 10. Furthermore, the ventilation slots 40 may have a width of 1.25 mm or less, enabling the ridge vent 10 to be used in a snowy climate without an added filter that may otherwise be required. However, it should be noted that the width of the ventilation slots 40 may vary according the design of one skilled in the art, while still remaining within the scope of the present invention.

Furthermore, the embodiment of the present invention illustrated in FIGS. 1 and 2 includes two separation lines 42, each forming one of the outer edge portions 60. As previously discussed herein, the separation lines 42 may extend generally parallel to the side edges 36, and may permit easy separation of the outer edge portion 60 of the elongated body 30. The separation lines 42 may be a groove, a score line, or a series of perforations or other suitable weakened portion of the elongated body 30 which permits or promotes easy separation of the outer edge portions 60 of the elongated body 30 to define a body of narrower width. Upon removing one or both outer edge portions 60 of the elongated body 30, a user may then reattach each outer edge portion 60 to the elongated body 30 as a means to alter the width of the ridge vent 10 according to the size of the cap shingles 28 being mounted on the pitched roof 20. This process will be discussed in greater detail below, but it generally allows for easy arrangement and modification of the ridge vent 10 at a jobsite.

Figure 3:
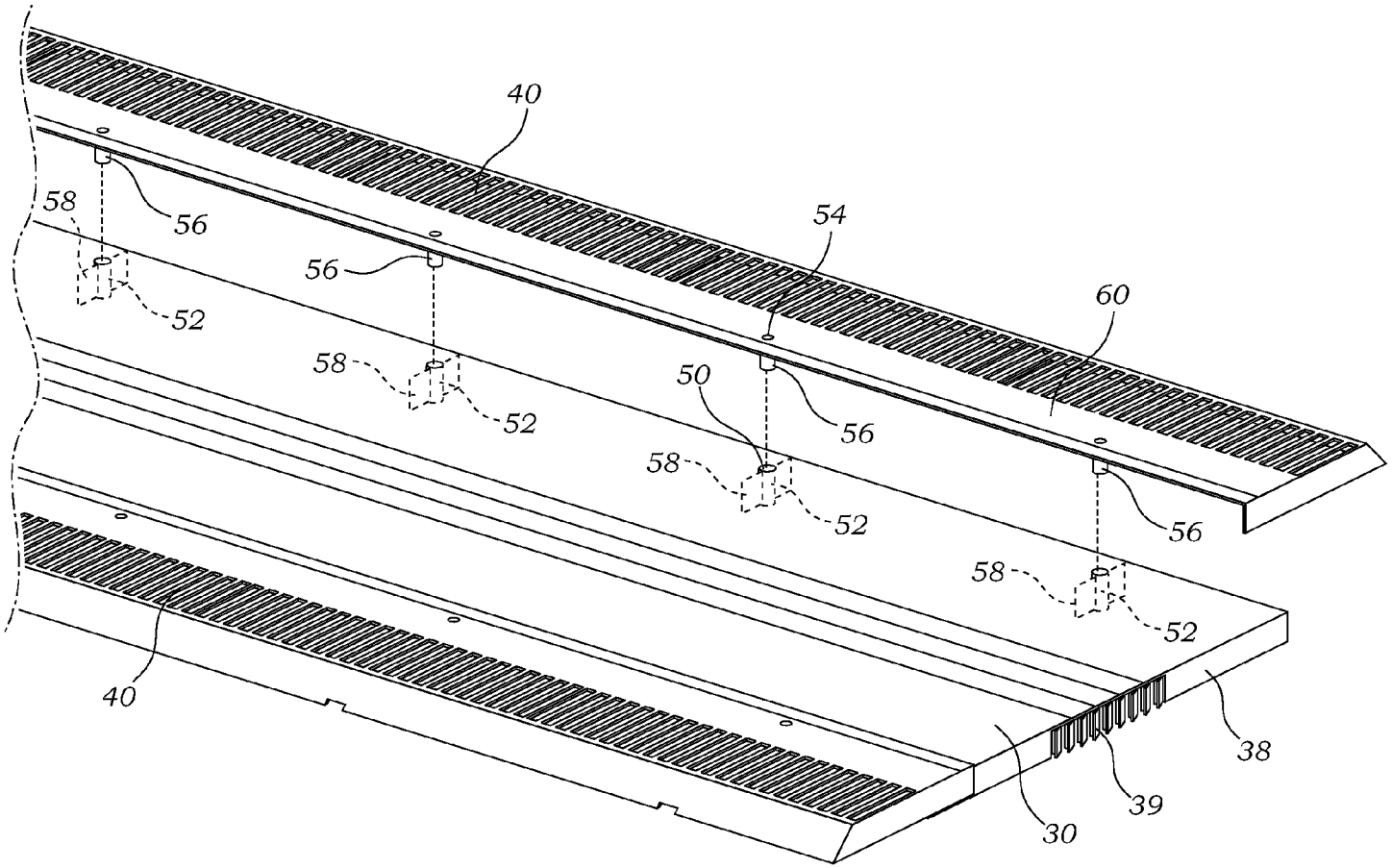
FIG. 3 is an exploded perspective of the ridge vent illustrating one of the outer edge portions removed from an elongated body for adjusting the width of the ridge vent.
Figure 4:
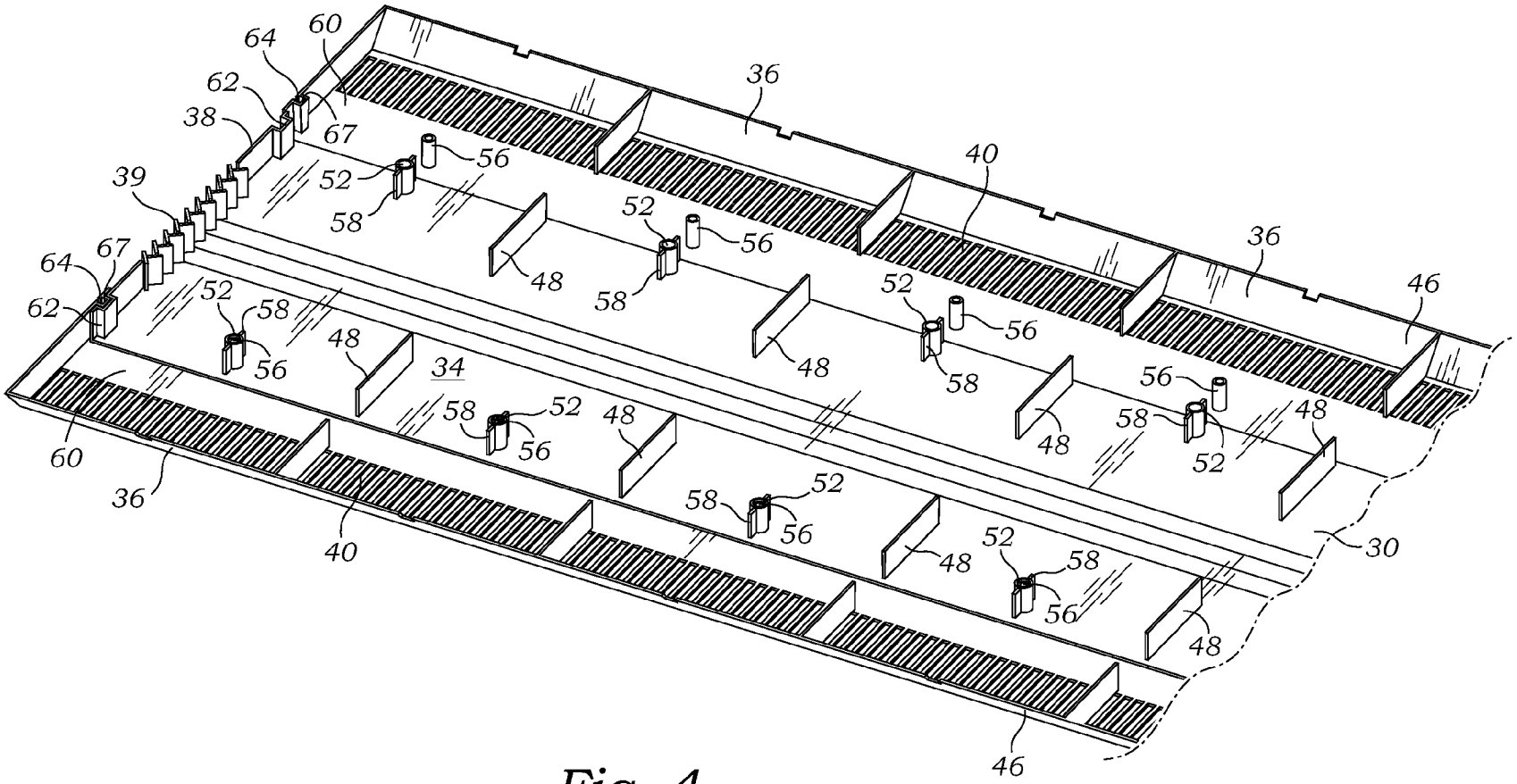
FIG. 4 is a bottom perspective view of the ridge vent of FIG. 3, illustrating a bottom surface of the ridge vent when the outer edge portion is re-mounted on the elongated body.

FIG. 3 is an exploded perspective of the ridge vent 10 illustrating one of the outer edge portions 60 removed from the elongated body 30 for adjusting the width of the ridge vent 10. FIG. 4 is a bottom perspective view of the ridge vent 10 of FIG. 3, illustrating a bottom surface 34 of the ridge vent 10 when the outer edge portion 60 is re-mounted on the elongated body 30. As illustrated in FIGS. 3 and 4, the width of the ridge vent 10 may be reduced by separating the outer edge portion 60 from the elongated body 30, overlapping it with the elongated body 30, and engaging mating cylindrical bodies 56 with downwardly extending cylindrical bodies 52. By adjusting the width of the ridge vent 10, then, the amount of time and supplies needed to install ventilation to a pitched roof 20 may be reduced and a variety of cap shingles 28 sizes may be accommodated.

It will be appreciated that the ridge vent 10 may be manufactured in any desired dimensions and made using various suitable materials. Current standard widths of cap shingles 28 are nine (9) inches and twelve (12) inches. Thus, the width of the top surface 32 of the ridge vent 10 is twelve (12) inches and the width of the top surface 32, when modified by separating and re-attaching the outer edge portions 60 of the elongated body 30, is nine (9) inches. One may also separate and re-attach only one outer edge portion 60 of the elongated body 30 in order to accommodate nonstandard cap shingle 28 sizes. Therefore, the present invention may include one separation line 42 so that adjustment is made with one outer edge portion 60, or two separation lines 42 that are either used alternatively or together to adjust to up to three different sizes. These dimensions may be changed, however, as required to accommodate other shingle widths and construction standards without departing from the principles of the present invention.

As illustrated in detail in FIGS. 3 and 4, the ridge vent 10 includes a variety of elements to allow for the re-attachment of the separated outer edge portion 60 back onto the elongated body 30. The ridge vent 10 includes a first set of holes 50 adjacent to the separation line 42, and a second set of holes 54. Each of the second set of holes 54 is adjacent the separation line 42 opposite one of the first set of holes 50.

Each of the first set of holes 50 is formed through the downwardly extending cylindrical body 52, while each of the second set of holes 54 forms the mating cylindrical body 56. The downwardly extending cylindrical body 52 may further include two wings 58 on opposite sides of the cylinder 52 in order to provide additional structural support. The mating cylindrical bodies 56 are adapted to engage and nest within the downwardly extending cylindrical bodies 52 of the first set of holes 50. Thus, one of the mating cylindrical bodies 56 is defined to meet and insert itself inside of one of the downwardly extending cylindrical bodies 52 to serve as a means for attaching the outer edge portion 60 back onto the elongated body 30. While one embodiment of these structures is illustrated herein, interlocking bodies of different shapes and configurations are included within the scope of the present invention, and in particular reversing the downwardly extending cylindrical bodies 52 and the mating cylindrical bodies 56 is hereby expressly defined within the scope of the present claims terminology.

As illustrated in the embodiment of FIGS. 3 and 4, a plurality of lateral support ridges 48 may be spaced between the downwardly extending cylindrical bodies 52 to provide further support to the ridge vent 10 and thus minimize the possibility of unwanted bending or cracking The lateral support ridges 48 may support the elongated body 30, but they do not form a baffle, and the bottom surface 34 is substantially clear of baffling between the plurality of ventilation slots 40 and the center of the elongated body 30. By removing the need for baffling, the present invention reduces the cost of materials required to manufacture the ridge vent 10.

While one embodiment of the cylindrical bodies 52 and 56 is illustrated, alternative embodiments may also be utilized. For example, while the downwardly extending cylindrical bodies 52 are illustrated as having round cross-sections, other forms and shapes may be used according to the design of one skilled in the art. The term cylindrical is hereby expressly defined to include any form of tubular construction having cross sections that are other than round/annular (e.g., a square or other cross sectional shape), as long as they are functional for the purposes described herein.

In the embodiment of FIGS. 3 and 4, the elongated body 30 may further include ends 38 which include first and a second interlocking component 62 and 64 to provide a further means for interconnecting the separated outer edge portion 60 onto the elongated body 30 when the cylindrical bodies 52 and 56 are engaged. The first interlocking component 62 is located on the elongated body 30 and the second interlocking component 64 is located on the outer edge portion 60. Both the first and second interlocking components 62 and 64 are shaped to interlock, and may be generally rectangular in shape; however, alternative shapes and structures may be utilized according to the design of one skilled in the art.

In use, when adjusting the width of the ridge vent 10, when the outer edge portion 60 is engaged with the ridge vent 10, the second interlocking component 64 may be inserted into the first interlocking component 62, so that it nests therein to further interconnect the outer edge portions 60 with the elongated body 30.

FIG. 5 is a bottom perspective exploded view of two of the ridge vents 10, illustrating a connector 65 used for connecting the two ridge vents 10 into one continuous length. The connector 65 operably engages a shaped portion 67 of the second interlocking component 64 is also used in conjunction with a connector 65 (of another ridge vent 10) to enable the ridge vents 10 to be daisy-chained together, regardless of the width of the ridge vent 10. As illustrated in FIGS. 2 and 5, one end 63 of the ridge vent 10 includes the connector 65, shaped to fit into and locking engage the second interlocking component 64 regardless of whether the outer edge portion 60 has been separated and reattached to the elongated body 30.

In the embodiment of FIGS. 2 and 5, the connector 65 includes a neck 66 and a larger portion 68 which are shaped to nest within and lockingly engage a shaped portion 67 of the second interlocking component 64. In the illustrated embodiment, the larger portion 68 is generally rectangular in shape, and the neck 66 has a smaller width, so that the larger portion 68 lockingly engages the shaped portion 67 (in this case, a T-shaped portion) of the second interlocking component 64, thereby joining the two ridge vents 10.

Figure 6:
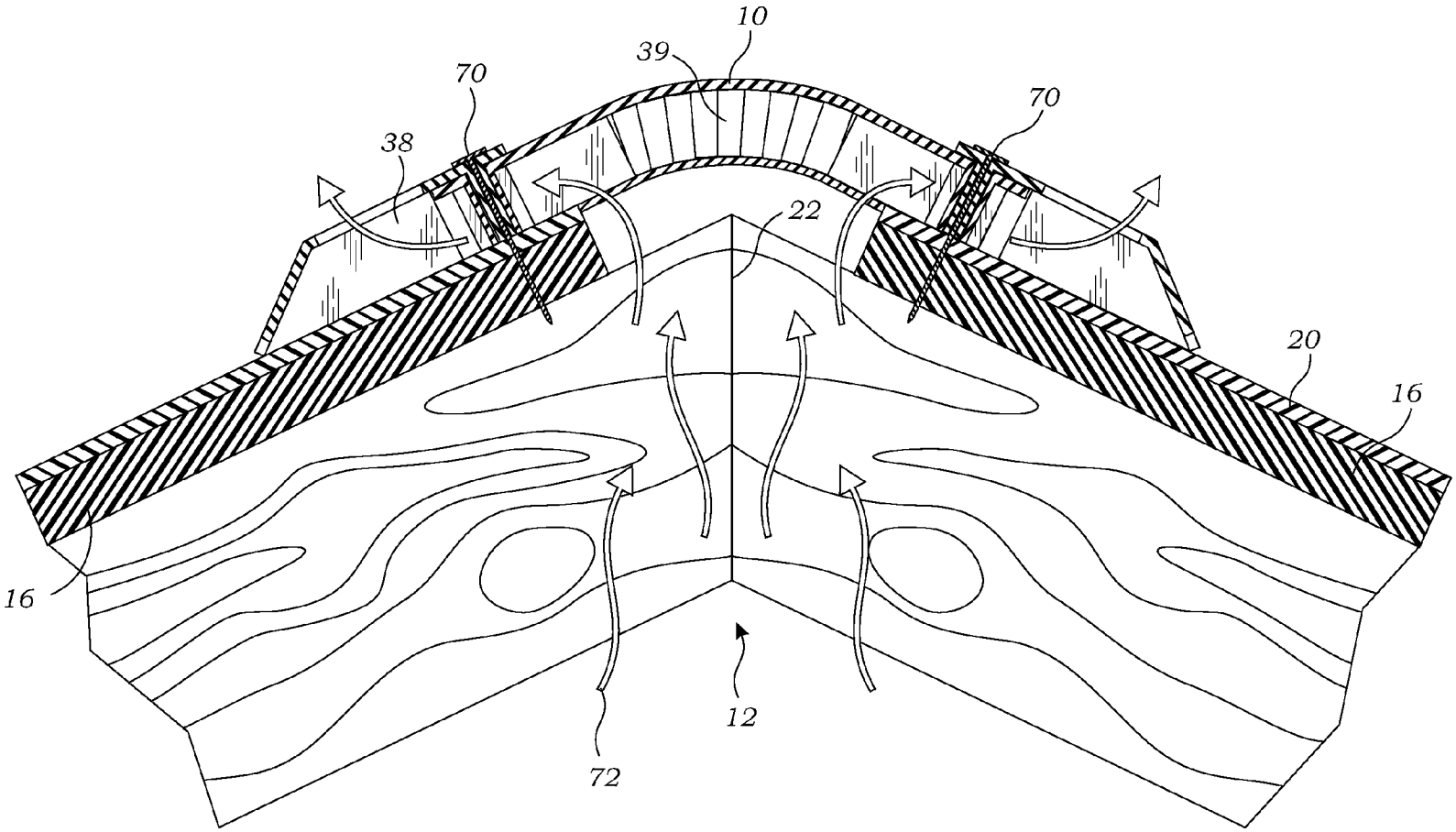
FIG. 6 is a front sectional view of the ridge vent once both of the outer edge portions have been broken from the elongated body and re-mounted in a narrower configuration and mounted on a roof, and further illustrating the direction of airflow during the ventilation process.

FIG. 6 is a front sectional view of the ridge vent 10 once both of the outer edge portions 60 have been broken from the elongated body 30 and re-mounted in a narrower configuration and mounted on the pitched roof 20, and further illustrating the direction of airflow 72 during the ventilation process. As illustrated in FIG. 6, inclined rafters 16 join with the ridge beam 18 to form the apex 22 of the pitched roof 20. The ridge vent 10 is then operably mounted to the apex 22 of the pitched roof 20 with fasteners 70 such as nails or other suitable means of fastening, such as screws, staples, etc. In operation, air 72 may freely flow from within the attic space 12 between the pitched roof 20 and the ceiling of the building, through the plurality of ventilation slots 40, and out to the atmosphere above the pitched roof 20. As such, the attic space 12, and by extension the building as a whole, may be ventilated and cooled in both a cost-effective and energy-efficient manner.

It should be noted that the ridge vent 10 may alternatively be formed in a continuous length of material and simply cut to length at the jobsite. Because the ridge vent 10 must be operably mounted to pitched roofs 20, the ridge vent 10 must be somewhat flexible to adapt to various roof pitch angles. Since the invention provides a single ridge vent 10 which may be used with either wide or narrow cap shingles 28, the necessity of producing, shipping, storage, etc., two types of ridge vents 10 is totally eliminated. Not only is the cost of duplicating and distributing duplicate structures eliminated, but inventory maintenance is also simplified and the inefficiencies and time consumed by accidental delivery to the jobsite of the wrong size of ridge vent 10 is avoided entirely.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A ridge vent comprising:

an elongated body having a top surface, a bottom surface, and side edges separated by a width;

a plurality of ventilation slots adjacent each of the side edges;

a separation line that permits easy separation of an outer edge portion of the elongated body extending generally parallel to one of the side edges from a central portion;

a first set of downwardly extending cylindrical body, each having a hole adjacent the separation line, a second set of downwardly extending cylindrical body, each having a hole, each of the second set of downwardly extending cylindrical bodies being adjacent the separation line opposite one of the first set of downwardly extending cylindrical bodies, each of the second set of downwardly extending cylindrical bodies are adapted to engage and nest within first set of the downwardly extending cylindrical wherein the width of the ridge vent may be reduced by separating the outer edge portion from the elongated body, overlapping it with the elongated body, and engaging the mating cylindrical bodies with the downwardly extending cylindrical bodies.

2. The ridge vent of claim 1, wherein the elongated body includes two separation lines, one adjacent each of the side edges.

3. The ridge vent of claim 1, wherein each of the side edges includes an outwardly extending portion that is generally parallel to the elongated body, and a downwardly extending wall; wherein the outwardly extending portion includes the plurality of ventilation slots; and wherein the downwardly extending wall is substantially unbroken, for excluding water.

4. The ridge vent of claim 1, wherein the elongated body further includes ends; wherein the ends have first and second interlocking components; and wherein the first interlocking component is located on the elongated body and the second interlocking component is located on the outer edge portion.

5. The ridge vent of claim 1, wherein the downwardly extending cylindrical body further includes two wings on opposite sides of the downwardly extending cylindrical body.

6. The ridge vent of claim 1, wherein the ventilation slots may have a width of 1.25 mm or less, allowing the ridge vent to be used in snowy climates.

7. The ridge vent of claim 1, wherein the elongate body further includes end walls extending the width of the elongate body.

8. The ridge vent of claim 7, wherein one of the end walls includes a first interlocking component and adjacent a second interlocking component, and wherein the first and second interlocking components nest within and operably engage each other when the mating cylindrical bodies are operably engaged with the downwardly extending cylindrical bodies.

9. The ridge vent of claim 8, further comprising a connector extending from the other of the end walls opposite the first and second interlocking components, wherein the connector is shaped to operably engage a shaped portion of the second interlocking component, such that the two ridge vents may be joined together via adjacent end walls.

10. The ridge vent of claim 9, wherein the connector includes a neck and a larger portion which are shaped to nest within and lockingly engage the shaped portion of the second interlocking component.

11. The ridge vent of claim 1, wherein the shaped portion of the connector is generally T-shaped.

12. A ridge vent comprising:

an elongated body having a top surface, a bottom surface, opposed side edges separated by a width, and end walls extending laterally between the side edges;

a plurality of ventilation slots adjacent each of the side edges;

a separation line that permits easy separation of an outer edge portion of the elongated body extending generally parallel to one of the side edges from a central portion;

a first set of downwardly extending cylindrical body, each having a hole adjacent the separation line, a second set of downwardly extending cylindrical body, each having a hole, each of the second set of downwardly extending cylindrical bodies being adjacent the separation line opposite one of the first set of downwardly extending cylindrical bodies, each of the second set of downwardly extending cylindrical bodies are adapted to engage and nest within the first set of downwardly extending cylindrical wherein the width of the ridge vent may be reduced by separating the outer edge portion from the elongated body, overlapping it with the elongated body, and engaging the mating cylindrical bodies with the downwardly extending cylindrical bodies; and first and second interlocking components formed in one of the end walls, the first and second interlocking component being shaped to nest within and operably engage are attached to each other when the mating cylindrical bodies are engaged with the downwardly extending cylindrical bodies.

13. A method for installing a ridge vent on a roof, the method comprising the steps of:

providing the ridge vent, the ridge vent comprising:

an elongated body having a top surface, a bottom surface, and side edges separated by a width;

a plurality of ventilation slots adjacent each of the side edges;

a separation line that permits easy separation of an outer edge portion of the elongated body extending generally parallel to one of the side edges from a central portion a first set of downwardly extending cylindrical body adjacent the separation line, a second set of downwardly extending cylindrical body, each having a hole, each of the second set of downwardly extending cylindrical bodies being opposite one of the first set of downwardly extending cylindrical bodies, each of the second set of downwardly extending cylindrical bodies are adapted to engage and nest within the first set of downwardly extending cylindrical body of;

separating the outer edge portion of the elongated body that includes the plurality of ventilation slots adjacent each of the side edges;

overlapping the outer edge portion with the central portion of the elongated body and engaging the mating cylindrical bodies with the downwardly extending cylindrical bodies; and inserting fasteners through the first and second holes and into the roof.

* * * * *